US008184847B2

(12) United States Patent
Bertoli et al.

(10) Patent No.: US 8,184,847 B2
(45) Date of Patent: May 22, 2012

(54) VEHICLE SPEAKER MOUNTING SYSTEM

(75) Inventors: John Bertoli, Columbus, OH (US); David Bryant, Dublin, OH (US); Steven Feit, Dublin, OH (US); Randall R. Roth, Dublin, OH (US)

(73) Assignee: Honda Motor Co., Ltd, Tokyo (JP)

( * ) Notice: Subject to any disclaimer, the term of this patent is extended or adjusted under 35 U.S.C. 154(b) by 1411 days.

(21) Appl. No.: 11/747,472

(22) Filed: May 11, 2007

(65) Prior Publication Data

US 2008/0279412 A1 Nov. 13, 2008

(51) Int. Cl.
*H04R 1/02* (2006.01)

(52) U.S. Cl. ..... 381/389; 296/187.11; 296/186.3

(58) Field of Classification Search ..... 381/389; 296/187.11, 186.3
See application file for complete search history.

(56) References Cited

U.S. PATENT DOCUMENTS

| | | | | |
|---|---|---|---|---|
| 1,757,719 | A | 5/1930 | Kent | |
| 2,141,423 | A | 12/1938 | Tolerton | |
| 3,778,101 | A * | 12/1973 | Tsuda | 296/154 |
| 3,993,345 | A | 11/1976 | Croup | |
| 4,143,249 | A * | 3/1979 | Cinquino | 381/389 |
| 4,166,933 | A | 9/1979 | Cinquino | |
| 4,484,658 | A | 11/1984 | Grote | |
| 4,847,907 | A | 7/1989 | Ando | |
| 4,853,966 | A | 8/1989 | Skrzycki | |
| 4,993,510 | A | 2/1991 | Kato et al. | |
| 5,273,243 | A * | 12/1993 | Abdallah et al. | 248/27.1 |
| 5,867,583 | A | 2/1999 | Hazelwood et al. | |
| 6,196,622 | B1 * | 3/2001 | Brodt et al. | 296/203.04 |
| 6,258,438 | B1 | 7/2001 | Loveland et al. | |
| 6,456,722 | B1 | 9/2002 | Davey et al. | |
| 6,773,057 | B2 * | 8/2004 | Nomura | 296/198 |
| 6,843,345 | B2 | 1/2005 | Koizumi et al. | |
| 2002/0097889 | A1 * | 7/2002 | Makino | 381/389 |
| 2002/0145309 | A1 * | 10/2002 | Shikata et al. | 296/208 |
| 2003/0019983 | A1 | 1/2003 | Iinuma et al. | |
| 2004/0247150 | A1 | 12/2004 | Iwaya et al. | |
| 2004/0264729 | A1 | 12/2004 | Ito et al. | |
| 2005/0184544 | A1 * | 8/2005 | Iverson et al. | 296/3 |

* cited by examiner

*Primary Examiner* — Davetta W Goins
*Assistant Examiner* — Amir Etesam
(74) *Attorney, Agent, or Firm* — Gregory J. Burke; Michael A. Forhan; Eley Law Firm Co.

(57) ABSTRACT

A vehicle speaker mounting system. The vehicle speaker mounting system comprises a parcel shelf having at least one stiffener extending substantially longitudinally along the length of the parcel shelf. The system further includes at least one aperture extending through a generally planar portion of the parcel shelf. The aperture is configured to receive a speaker.

17 Claims, 11 Drawing Sheets

VEHICLE SPEAKER MOUNTING SYSTEM

FIELD OF THE INVENTION

The present invention relates generally to mounting systems for speakers, in particular a structurally reinforced system for mounting speakers within a vehicle.

BACKGROUND

Many passenger vehicles include a parcel shelf located behind the rear passenger seats that extends to the base of the rear window and trunk area. Automakers often utilize the parcel shelf as a mounting platform for components such as stereo speakers. As automakers strive to increase the quality of vehicle sound systems the need has arisen for the installation of larger and/or more speakers in the rear parcel shelf.

Parcel shelves in the current art are typically produced from a single layer of sheet steel in a desired shape and having structural features such as strengthening ribs. Speakers mounted to these parcel shelves are inserted into apertures cut or punched in the sheet material and attached thereto by fasteners such as screws or nuts and bolts. The speakers are accordingly supported only by the sheet material of the parcel shelf. This configuration may provide adequate support for holding the speakers in position, but has a shortcoming in that the parcel shelf may allow the speaker body to move or vibrate during operation. If the speaker body is allowed to move or vibrate the efficiency of the speaker's output is decreased, with a corresponding decrease in the quality of the sound emitted by the speaker. Furthermore, vibration of the speaker body against the parcel shelf can generate unwanted noise which may be bothersome to passengers and can loosen nearby fasteners and connections.

As part of the drive for increased sound quality, automakers are offering a more diverse variety of speakers that require greater structural support than speakers previously offered. For example, current parcel shelf designs may provide adequate support for relatively low power speakers that have frequency responses in the mid- to high-frequency ranges, but such parcel shelves may not be able to adequately support higher-power woofer or subwoofer speakers and prevent the speakers from moving or vibrating in their mounts. These higher-power, low-frequency speakers produce strong vibrations that can cause the speaker body to move if not properly secured and require a more stable and rigid mounting structure than is currently available.

There is a need for a vehicle speaker mounting system that supports a speaker mounted in a rear parcel shelf so as to limit movement or vibration of the speaker body during operation.

SUMMARY

A vehicle speaker mounting system is disclosed according to an embodiment of the present invention. The vehicle speaker mounting system is located generally behind a rear passenger seat and extends to the rear window and trunk area. Stiffeners located along front and rear portions of the parcel shelf increase the rigidity of the parcel shelf to better support speakers located therein.

An aspect of the present invention is a vehicle speaker mounting system. The vehicle speaker mounting system comprises a parcel shelf having at least one stiffener extending substantially longitudinally along the length of the parcel shelf. The system further includes at least one aperture extending through a generally planar portion of the parcel shelf. The aperture is configured to receive a speaker.

Another aspect of the present invention is a vehicle speaker mounting system comprising a parcel shelf having a forward stiffener proximate a front edge of the parcel shelf. The forward stiffener extends substantially longitudinally along the length of the parcel shelf and has a flange that is joined to an underside of the parcel shelf. An aft stiffener is proximate a rear edge of the parcel shelf. The aft stiffener extends substantially longitudinally along the length of the parcel shelf and has a flange that is joined to the underside of the parcel shelf. A generally planar portion extends between the forward stiffener and the aft stiffener, and at least one aperture extends through the generally planar portion. The aperture is configured to receive a speaker.

Yet another aspect of the present invention is a method for mounting a speaker into a vehicle. The method includes the step of installing into the vehicle a parcel shelf having at least one stiffener extending substantially longitudinally along the length of the parcel shelf and at least one aperture extending through a generally planar portion of the parcel shelf. At least one speaker is mounted into an aperture. The speaker is then secured to the parcel shelf. The stiffener deters vibration generated by movement of at least one of the speaker and the parcel shelf.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
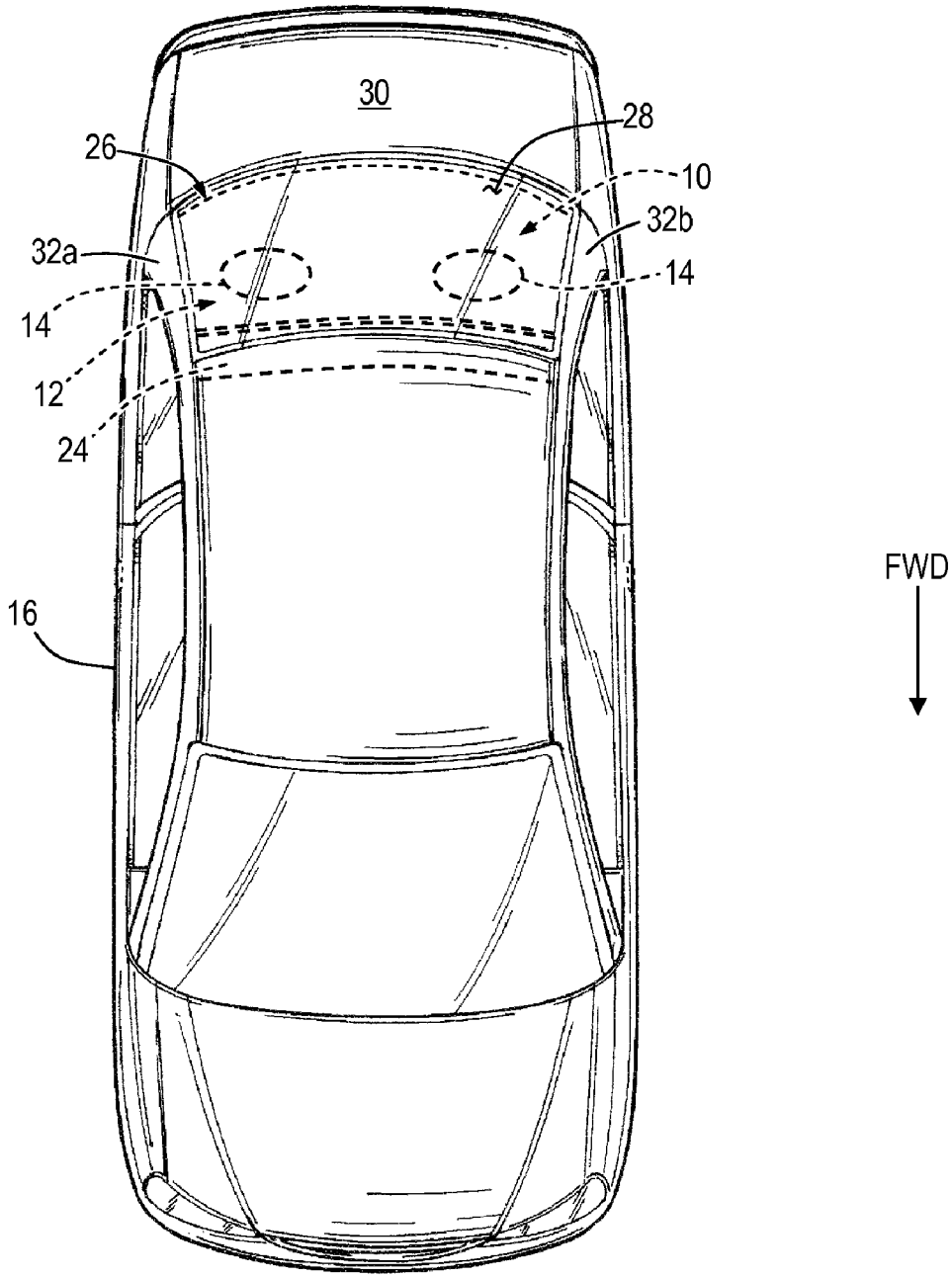
FIG. 1 depicts the general arrangement of a vehicle speaker mounting system installed into a vehicle according to an embodiment of the present invention.

In the discussion that follows like reference numerals are used to represent like elements in the various views and embodiments.

With reference to FIGS. 1-7 a vehicle speaker mounting system 10 is depicted according to an embodiment of the present invention. Vehicle speaker mounting system 10 comprises in relevant part a parcel shelf 12 into which a speaker 14 is mounted.

Figure 2A:
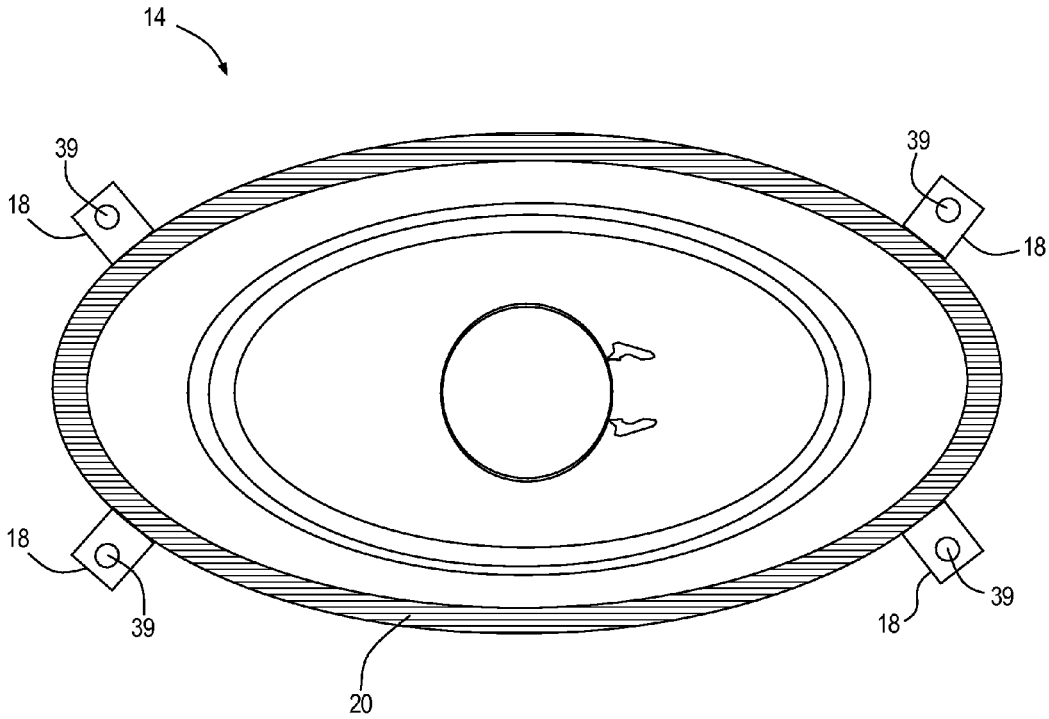
FIG. 2A is a top plan view of a speaker according to an embodiment of the present invention.
Figure 2B:
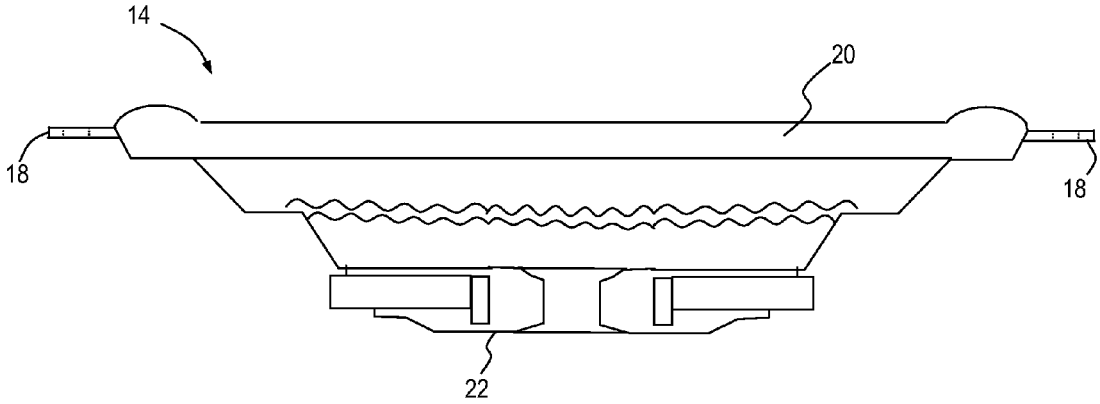
FIG. 2B is a side elevational view of the speaker of FIG. 2A.
Figure 3:
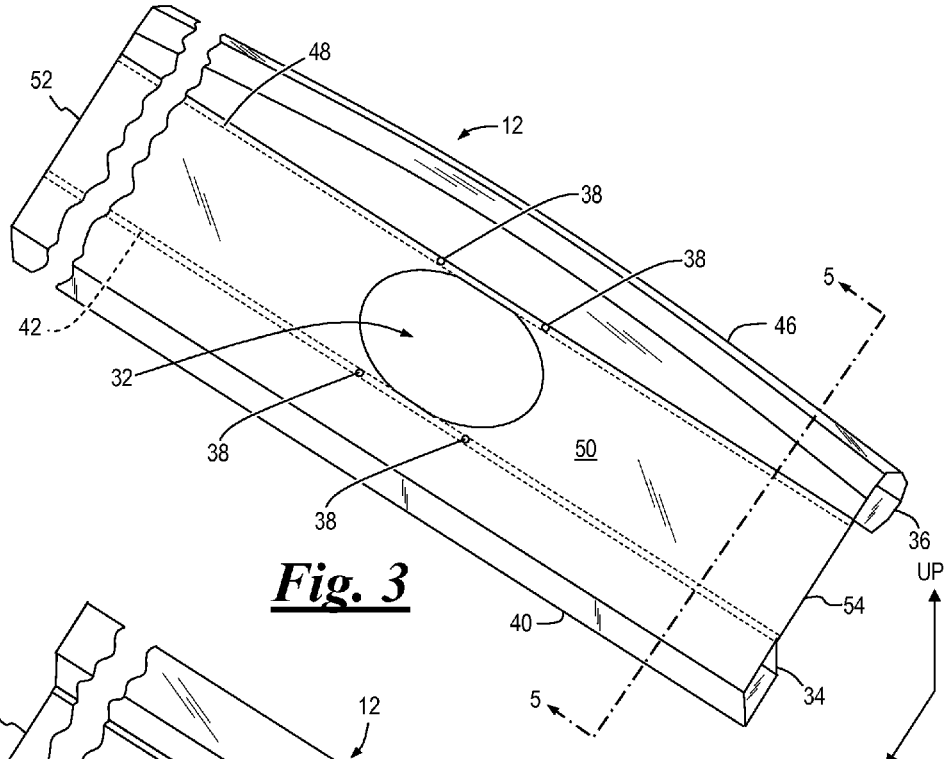
FIG. 3 shows details of a parcel shelf component of a vehicle speaker mounting system according to an embodiment of the present invention.
Figure 4:
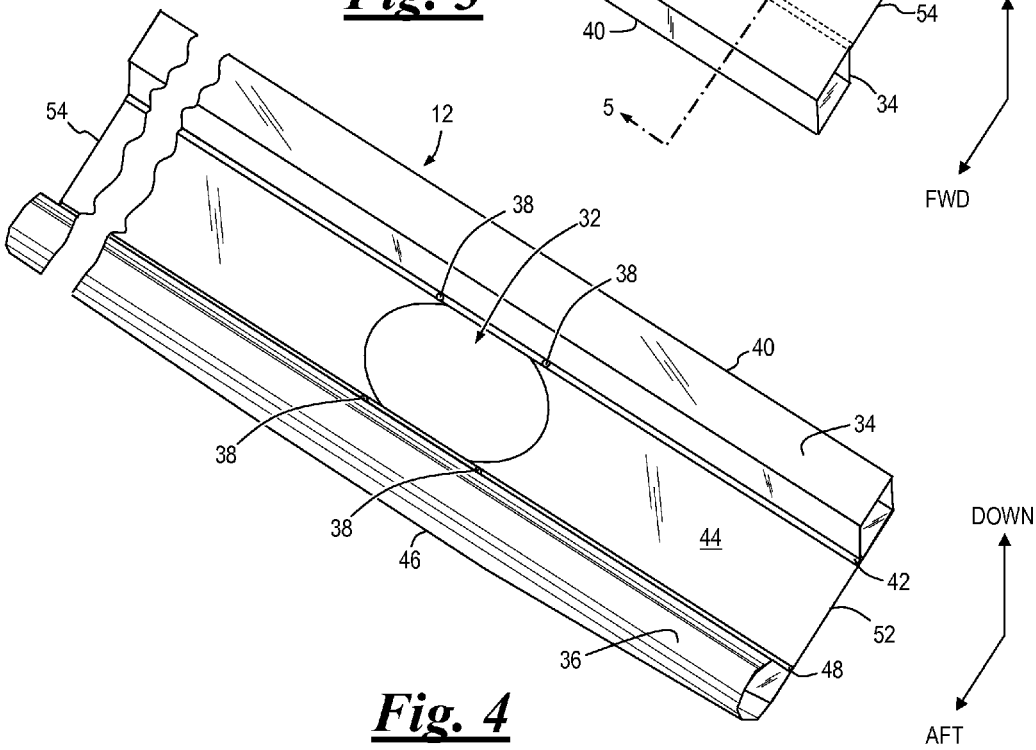
FIG. 4 shows details of the underside of the parcel shelf of FIG. 3.
Figure 5:
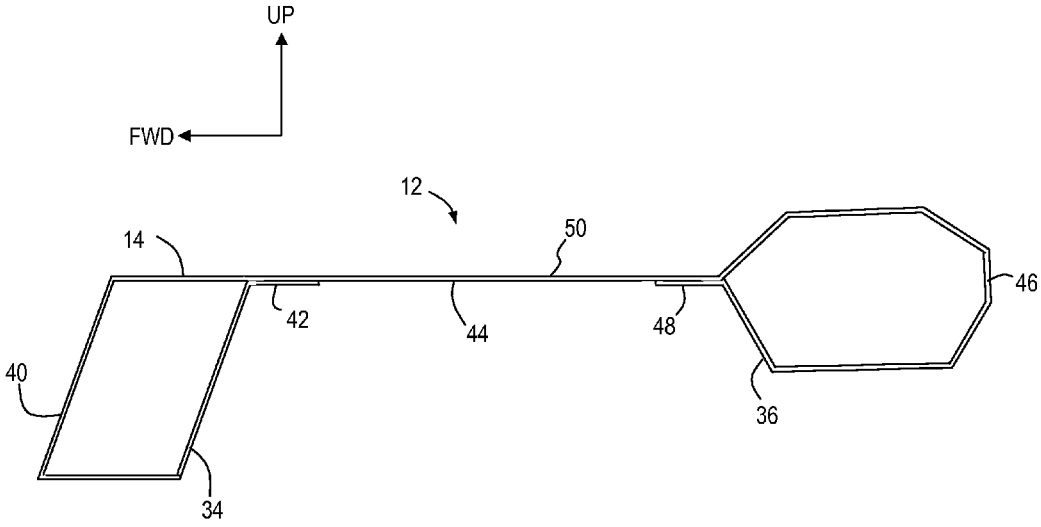
FIG. 5 is a view in section of the parcel shelf of FIG. 3.
Figure 7:
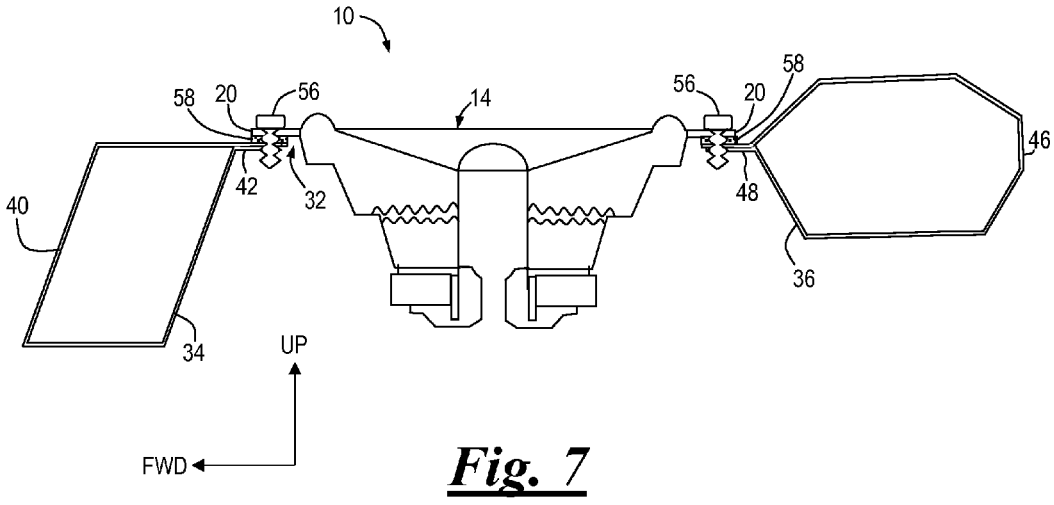
FIG. 7 is a view in section of the vehicle speaker mounting system of FIG. 6.
Figure 6:
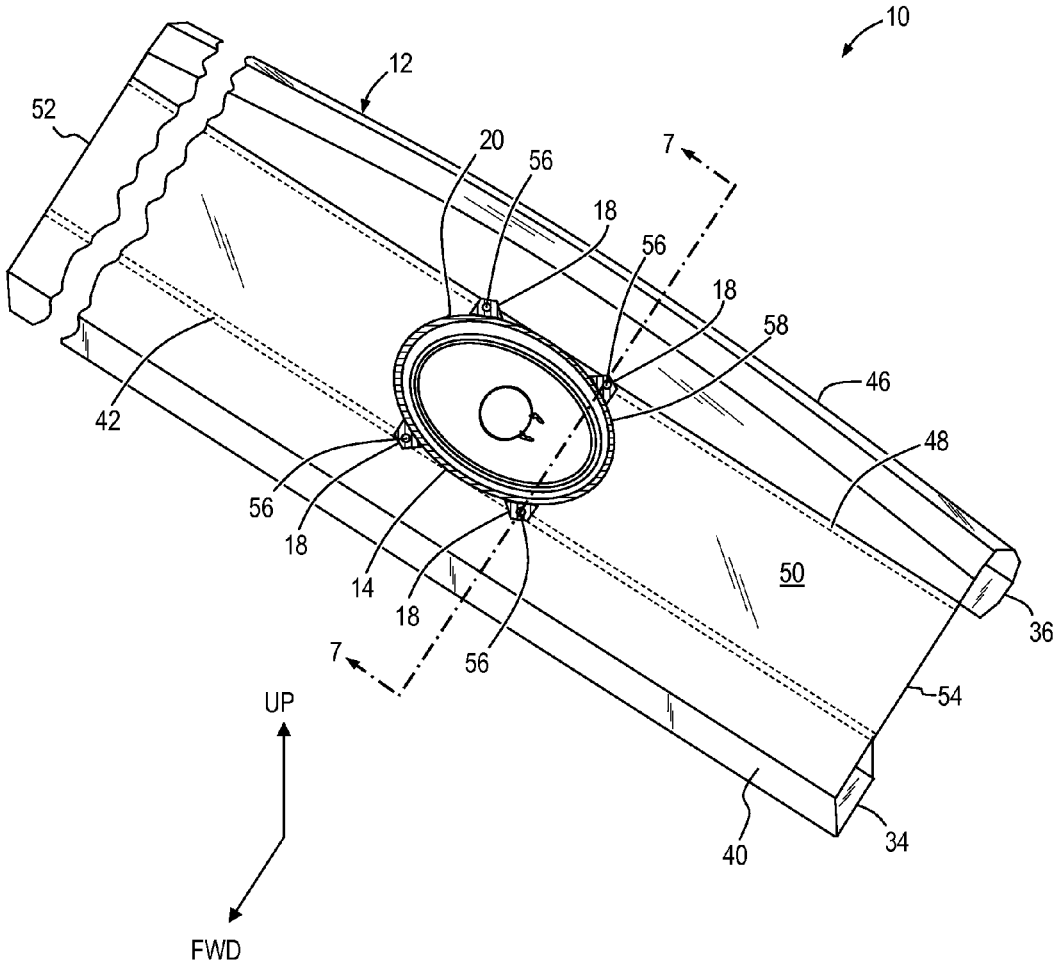
FIG. 6 shows details of a vehicle speaker mounting system according to an embodiment of the present invention.

With particular reference to FIG. 2A, Speaker 14 may be any type of speaker compatible with a conventional vehicle audio system (not shown) used in a vehicle 16. For example, speaker 14 may be a subwoofer. Other types of speakers may also be utilized including, without limitation, woofers, midranges, tweeters and combination or "multi-way" speakers having a plurality of speakers assembled into a unitary body. Speaker 14 may be of any physical size, diameter, depth, or shape that is compatible with the location in which the speaker is to be mounted and may further have any desired electrical and/or acoustic characteristics such as power rating, impedance and response frequencies, among others, that are compatible with the vehicle's audio system. Speaker 14 further comprises one or more mounting tabs 18 and a retaining flange 20 around the perimeter. In some embodiments tabs 18 may be integral to speaker flange 20. A body or frame 22 extends generally perpendicularly to flange 20. A single speaker 14 or a plurality of speakers may be mounted in a vehicle using vehicle speaker mounting system 10.

With particular reference to FIGS. 1, 3, 4 and 5, parcel shelf 12 is generally planar and is generally horizontally oriented within vehicle 16, being installed aft of a rear passenger seat 24 in the vehicle. Parcel shelf 12 typically extends substantially between rear passenger seat 24 and a region 26, which is located proximate the base of a rear window 28 and a forward portion of a vehicle trunk 30. Parcel shelf 12 also extends laterally across the width of the interior of vehicle 16, typically substantially between a pair of C-pillars 32*a*, 32*b*. Parcel shelf 12 accordingly forms a generally horizontal shelf behind the rear passenger seat 24 and may also form an upper enclosing portion of the trunk of the vehicle. Parcel shelf 12 may be utilized as a mounting surface for vehicle speakers 14 and other items, such as center high-mounted brake lights, the rear window and cargo tie downs.

Parcel shelf 12 includes one or more apertures 32, a forward stiffener 34 and an aft stiffener 36. Aperture 32, which is cut or stamped into parcel shelf 12, is situated in a planar portion generally between forward stiffener 34 and aft stiffener 36. Aperture 32 extends through parcel shelf 12 and is shaped to receive speaker 14. Aperture 32 is generally sized and shaped to permit all but mounting tabs 18 and retaining flange 20 to pass through the aperture such that the body 22 of the speaker extends away from parcel shelf 12. One or more fastener openings 38 are situated in parcel shelf 12 in a predetermined pattern corresponding to openings 39 in mounting tabs 18 of speaker 14.

Forward stiffener 34, which is located proximate a front edge 40 of parcel shelf 12, comprises a generally enclosed, hollow portion extending substantially longitudinally along the length of the parcel shelf and is oriented such that the forward stiffener projects downwardly into the trunk portion of the vehicle. The size and cross-sectional shape of forward stiffener 34 is not critical and may be varied to suit the design of a particular vehicle 16.

Forward stiffener 34 may be integrally formed with parcel shelf 12 by any of folding, forming and bending the parcel shelf material into the desired size and shape. A flange 42, formed as part of forward stiffener 34, is a generally planar section extending substantially longitudinally along the length of parcel shelf 12 and is positioned proximate an underside 44 of the parcel shelf. Flange 42 is attached to underside 44 in any conventional manner including, without limitation, welding, soldering, using fasteners such as self-tapping screws or nuts and bolts, and using adhesives. In an alternate embodiment forward stiffener 34 may be constructed separately by any conventional process, such as folding, forming, casting and machining, and then attached to parcel shelf 12 by any conventional joining process such as welding, soldering, fastening and using adhesives.

Aft stiffener 36, which is located along a rear edge 46 of parcel shelf 12, comprises a generally enclosed, hollow portion extending substantially longitudinally along the length of the parcel shelf and is oriented such that the aft stiffener projects downwardly into the trunk portion of the vehicle. The size and cross-sectional shape of aft stiffener 36 is not critical and may be varied to suit the design of a particular vehicle 16.

Aft stiffener 36 may be integrally formed with parcel shelf 12 by any of folding, forming and bending the parcel shelf material into the desired size and shape. A flange 48, formed as part of aft stiffener 36, is a generally planar section extending substantially longitudinally along the length of parcel shelf 12 and is positioned proximate underside 44 of the parcel shelf. Flange 48 is attached to underside 44 in any conventional manner including, without limitation, welding, soldering, using fasteners such as self-tapping screws or nuts and bolts, and using adhesives. In an alternate embodiment aft stiffener 36 may be made separately by any conventional process, such as folding, forming, casting and machining, then attached to parcel shelf 12 by any conventional joining process such as welding, soldering, fastening and using adhesives.

Parcel shelf 12 is typically constructed from a sheet metal such as steel, but may also be fabricated from other metals such as aluminum. Other materials, such as plastic or composites, may also be used. In various embodiments parcel shelf 12 may be stamped, formed, machined, cast, molded, vacuum-formed and hydro-formed to achieve the desired size, shape and features. Parcel shelf 12 may be finished by any conventional process such as, without limitation, plating, texturing and painting, or may be left unfinished. An upper surface 50 of parcel shelf 12, which is exposed to the interior of the vehicle, is typically covered with one or more layers of covering materials such as cloth, foam or fabric to provide an aesthetic appearance and dampen road noise.

Referring now to FIGS. 1-7, the assembly of vehicle speaker mounting system 10 is shown according to an embodiment of the present invention. Parcel shelf 12 is installed into vehicle 16 (FIG. 1) and attached to structural members of the vehicle by any conventional process including, without limitation, soldering, welding, fastening and using adhesives. In various embodiments parcel shelf 12 may be attached to the vehicle proximate lateral ends 52, 54 only, along the forward stiffener 34 and/or aft stiffener 36 at edges 40, 46 only, at spaced-apart points around the periphery of the parcel shelf or attached continuously around the periphery of the parcel shelf. One or more speakers 14 are each installed into a corresponding aperture 32 such that mounting tabs 18 and retaining flange 20 are positioned proximate and resting upon upper surface 50, and body 22 of the speaker extends generally away from parcel shelf 12. Conversely, speaker 14 may be mounted such that mounting tabs 18 and retaining flange 20 are located proximate underside surface 44 and body 22 extends generally away from parcel shelf 12, the speaker thus being suspended from the parcel shelf. Openings 39 in mounting tabs 18 are aligned with corresponding fastener openings 38 in parcel shelf 12, then secured with fasteners 56 such as screws or nuts and bolts.

In operation, vehicle speaker mounting system 10 provides a reinforced mounting platform for speaker 14. Forward stiffener 34 and aft stiffener 36 act to increase the rigidity of parcel shelf 12 and strengthen fastener openings 38 for speaker 14 by reinforcing the steel sheet material forming the parcel shelf. Forward stiffener 34 and aft stiffener 36 also provide support for fastener openings 38 and provide additional support for speaker 14 in those areas where retaining flange 20 of the speaker is located proximate flanges 42, 48. By increasing the rigidity of parcel shelf 12 and the amount of support provided to speaker 14 the potential for vibration between the speaker and parcel shelf 12 during speaker operation is reduced. In addition, the output efficiency of speaker 14 may be increased because the amount of energy lost to vibration or movement of speaker body 22, other than that intended for sound production, is decreased.

In some embodiments a resilient dampening material 58 may be placed between flange 20 of speaker 14 and upper surface 50 of parcel shelf 12 such that the dampening material generally surrounds aperture 32. Dampening material 58 acts as a shock and vibration absorber, aiding to isolate speaker 14 from parcel shelf 12. Dampening material 58 may be made from any suitable shock and vibration-absorbing material including, without limitation, rubber, foam and felt.

With reference to FIGS. 8 through 11B, in an alternate embodiment of the present invention a vehicle speaker mounting system 100 comprises a parcel shelf 12 and a mounting adapter 102 configured to attach to a speaker 104 having a shape and/or size differing from that of aperture 32. Mounting adapter 102 generally provides greater adaptability of speaker 104 to various speaker mounting locations and apertures 32 in parcel shelf 12 where the speaker alone would be difficult to mount due to its size or shape. Mounting adapter 102 may also be configured to permit various sizes of speakers 104 to be mounted in a common aperture 32 size and shape and to close gaps between the speaker and parcel shelf 12, among other mounting options.

Figure 9:
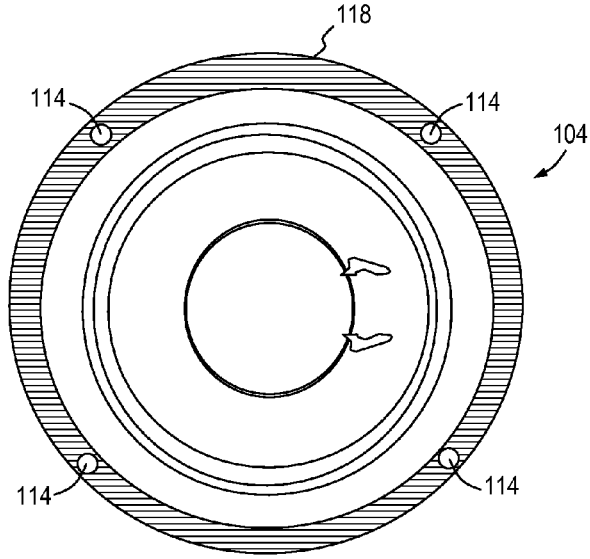
FIG. 9 is a top plan view of a speaker mountable to the mounting adapter of FIG. 8.

Mounting adapter 102 is shaped and sized to fit aperture 32, and may include one or more mounting tabs 106 having mounting holes 108. In some embodiments mounting tabs 106 may be integral to a frame 109 of adapter 102. An interior opening 110 in mounting adapter 102 is sized and shaped to receive speaker 104. A plurality of speaker mounting holes 112 proximate the perimeter of opening 110 are configured to correspond with mounting holes 114 of speaker 104. It should be noted that speaker 104 of FIG. 9 is but one non-limiting example of the various sizes and shapes of speaker that may be accommodated by various configurations of mounting adapter 102, the size and shape of interior opening 110 being configured to match that of a particular speaker. Likewise, the number and locations of mounting holes 112 may be varied to match a particular speaker, or may be eliminated altogether in favor of other mounting methods such as, for example, adhesive, clips, clamps, connectors and a press-fit.

Mounting adapter 102 may be constructed from any material that is compatible with speaker 104 and parcel shelf 12 and which is suitable for the expected environment of vehicle speaker mounting system 100. Example materials include, without limitation, metal, plastic and composite materials. Mounting adapter 102 may be produced using any conventional manufacturing process, such as molding, casting and machining. Furthermore, mounting adapter 102 may be finished by painting, texturing or plating, or may be left unfinished.

Figure 10:
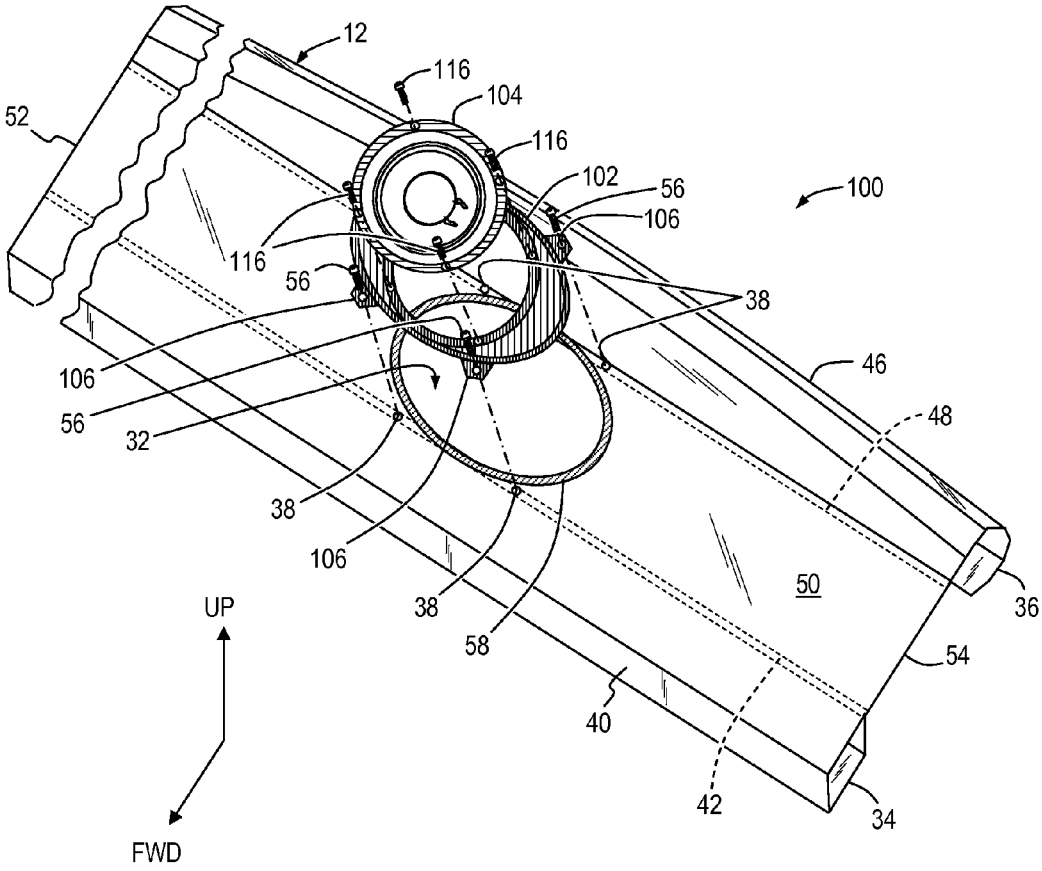
FIG. 10 is an exploded view showing the assembly of a vehicle speaker mounting system according to an alternate embodiment of the present invention.
Figure 11A:
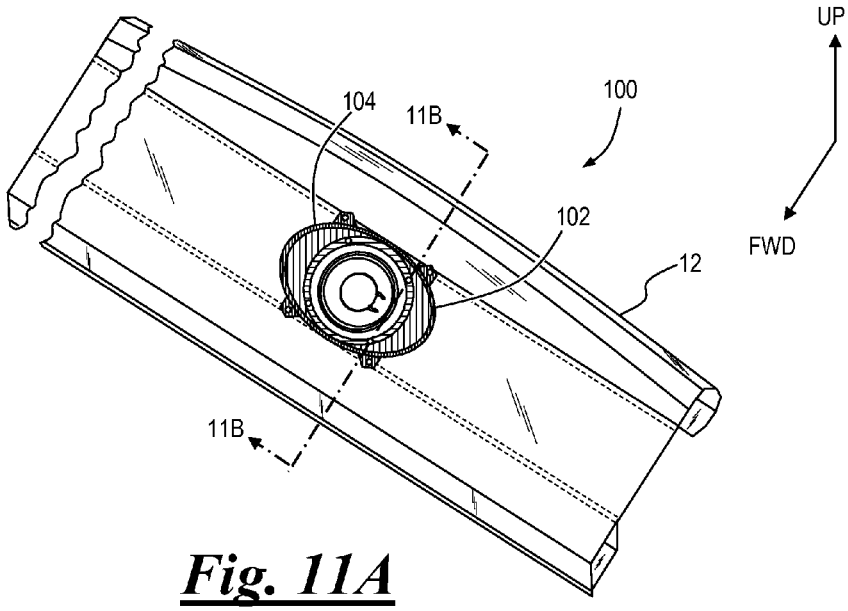
FIG. 11A shows the general arrangement of a vehicle speaker mounting system according to another alternate embodiment of the present invention.
Figure 11B:
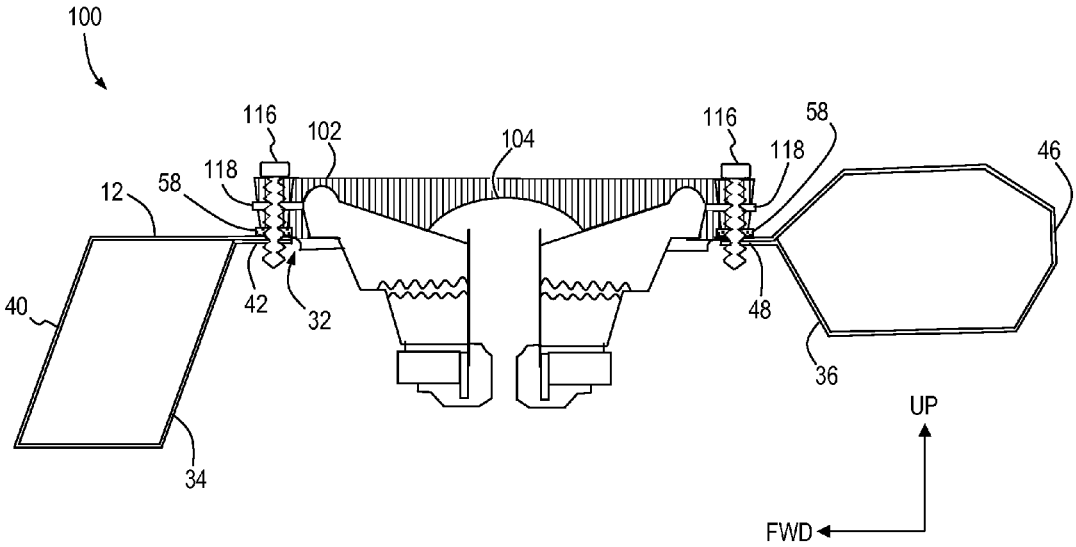
FIG. 11B is a view in section of a parcel shelf component of the system of FIG. 11A.

Vehicle speaker mounting system 100 is assembled by first inserting speaker 104 into interior opening 110 of mounting adapter 102 and securing the speaker to the mounting adapter using one or more fasteners 116, such as self-tapping screws and nuts and bolts, through corresponding mounting holes 114 located about a retaining flange 118 of the speaker, as depicted in FIG. 10. A dampening material 58 may be placed between speaker 104 and mounting adapter 102 in the manner discussed above for vehicle speaker mounting system 10. The assembled mounting adapter 102 and speaker 104 are then inserted into aperture 32 such that the mounting adapter rests atop upper surface 50 and a body portion of speaker 104 (similar to body portion 22 of speaker 14, shown in FIG. 2B) extends through aperture 32. Mounting tabs 106 of mounting adapter 102 are first aligned with corresponding mounting holes 38 of parcel shelf 12, then one or more fasteners 56 are inserted through openings 108 of mounting adapter 102 and corresponding mounting holes 38 to secure speaker 104 and the mounting adapter to parcel shelf 12. Fasteners 56 may comprise nuts attached to underside 44 of parcel shelf 12 and bolts inserted through corresponding openings 108 and 38 to couple with the nuts. In other embodiments self-tapping screws or adhesives may be used.

Figure 8:
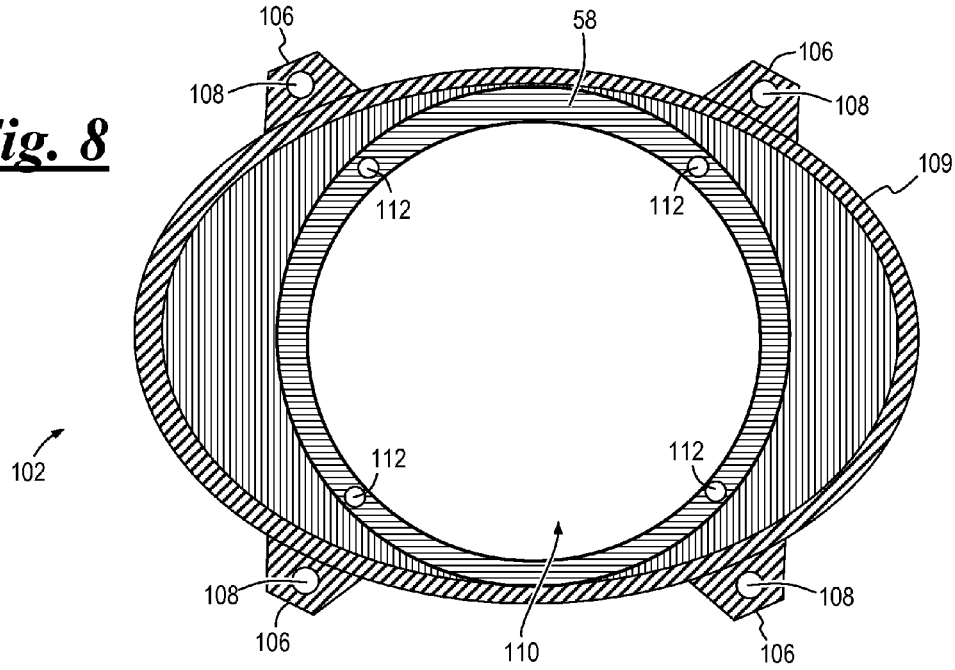
FIG. 8 is a top plan view of a speaker mounting adapter according to an embodiment of the present invention.
Figure 12A:
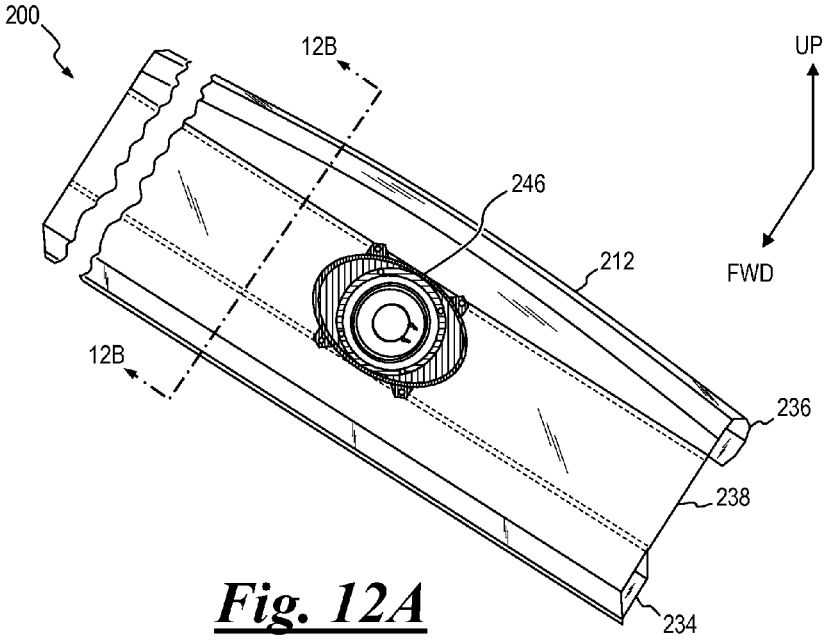
FIG. 12A shows the general arrangement of a vehicle speaker mounting system according to still another alternate embodiment of the present invention.
Figure 12B:
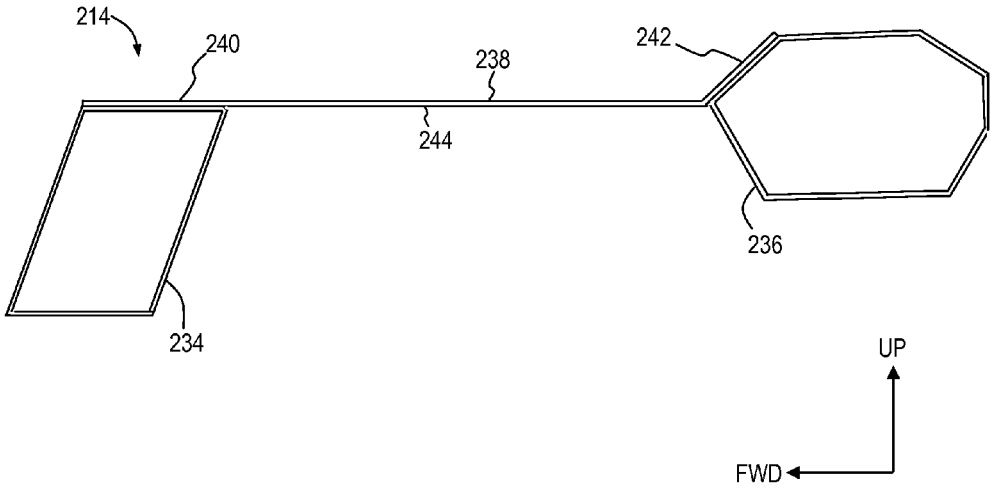
FIG. 12B is a view in section of a parcel shelf component of the system of FIG. 12A.

Referring now to FIGS. 12A and 12B a vehicle speaker mounting system 200 is depicted according to an alternate embodiment of the present invention. A parcel shelf 212 comprises a forward stiffener 234, an aft stiffener 236 and a generally planar member 238, each being separately constructed. Forward stiffener 234, aft stiffener 236 and planar member 238 may each be made from the same or dissimilar materials. Example materials include, without limitation, steel, aluminum, plastics or composites, among others. Planar member 238 is shaped to form a pair of flanges 240 and 242 on opposing longitudinal edges for attaching forward stiffener 234 and aft stiffener 236, respectively, to planar member 238. Planar member 238 is fabricated as desired by any conventional method, such as by bending, folding, or stamping, among other methods. Conversely, flanges 240 and 242 may be formed as part of forward stiffener 234 and aft stiffener 236, respectively. Flanges 240, 242 are joined to an underside 244 of parcel shelf planar member 238 by any conventional means including, without limitation, using fasteners, welding, soldering and gluing, among others. A speaker 246 may be similar to speaker 14 (FIG. 2A) for direct mounting to parcel shelf 212, or may be similar to speaker 104 (FIG. 9), in which case a mounting adapter 102 such as shown in FIG. 8 may be employed in the manner described above for vehicle speaker mounting system 100. Vehicle speaker mounting system 200 is otherwise similar in construction and assembly to vehicle speaker mounting system 10 and so will not be reiterated here. Likewise, parcel shelf 212 may be used interchangeably with the parcel shelf in vehicle speaker mounting systems 100, 300, 400 discussed herein.

Figure 13A:
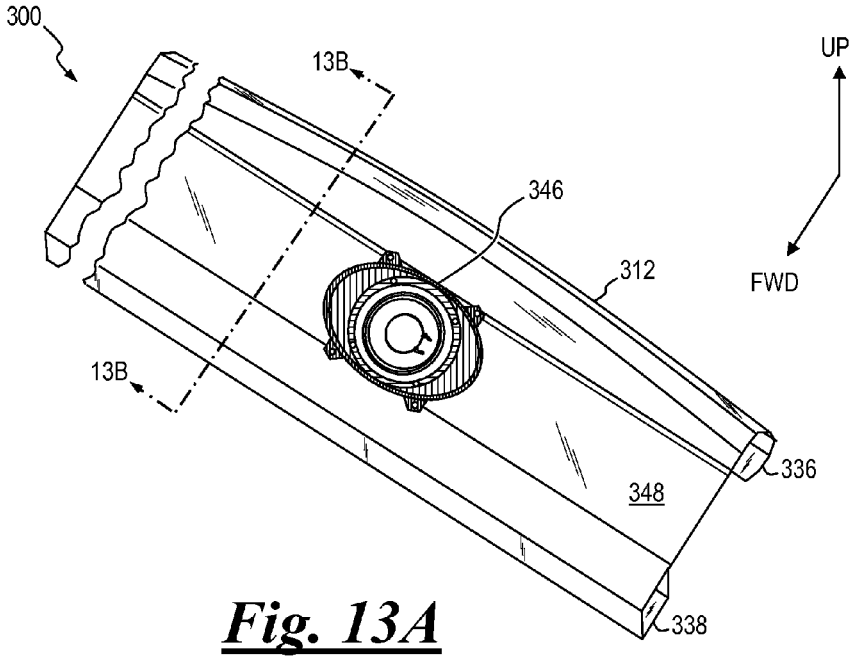
FIG. 13A shows the general arrangement of a vehicle speaker mounting system according to yet another alternate embodiment of the present invention.
Figure 13B:
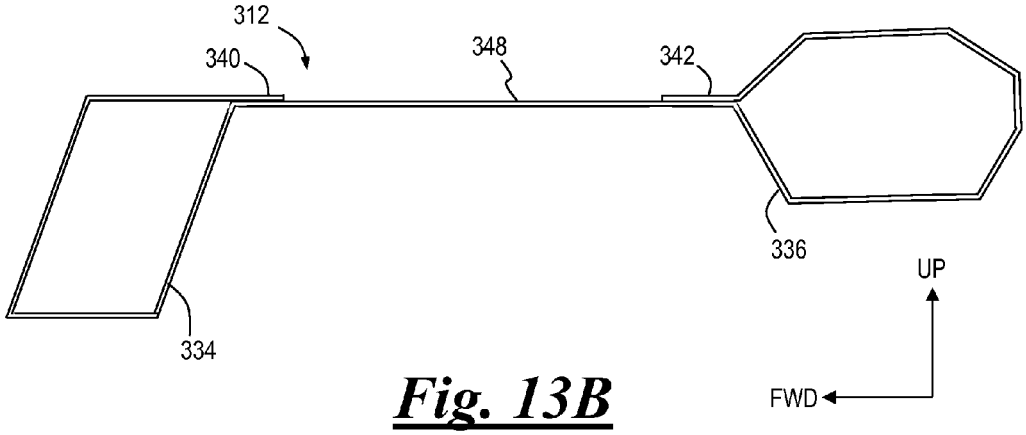
FIG. 13B is a view in section of a parcel shelf component of the system of FIG. 13A.

With reference now to FIGS. 13A and 13B a vehicle speaker mounting system 300 is depicted according to another alternate embodiment of the present invention. A parcel shelf 312 includes a forward stiffener 334 and an aft stiffener 336 formed from a single piece of material in a manner similar to vehicle speaker mounting system 10, except that the material is folded, bent or otherwise manipulated upwardly over an upper surface 348 of the parcel shelf to form the forward and aft stiffeners. This embodiment includes a forward stiffener flange 340 and an aft stiffener flange 342 that are joined to upper surface 348 by any conventional method, such as welding, using fasteners or adhesives, among others. A speaker 346 may be similar to speaker 14 (FIG. 2A) for direct mounting to parcel shelf 312, or may be similar to speaker 104 (FIG. 9), in which case a mounting adapter 102 such as shown in FIG. 8 may be employed in the manner described above for vehicle speaker mounting system 100. Vehicle speaker mounting system 300 is otherwise similar in construction and assembly to vehicle speaker mounting system 10 and so will not be reiterated here. Likewise, parcel shelf 312 may be used interchangeably with the parcel shelf in vehicle speaker mounting systems 100, 200, 400 discussed herein.

Figure 14A:
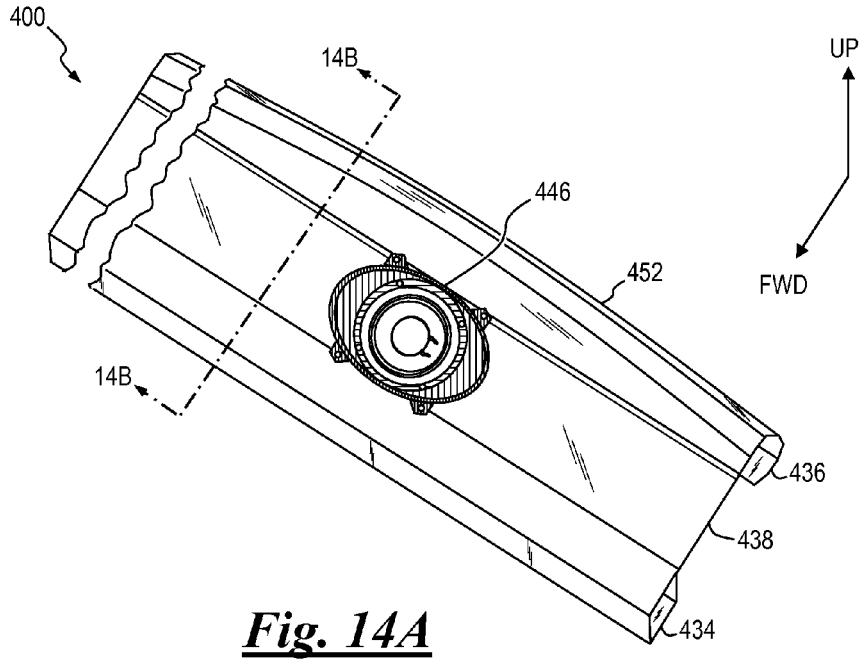
FIG. 14A shows the general arrangement of a vehicle speaker mounting system according to still another alternate embodiment of the present invention.
Figure 14B:
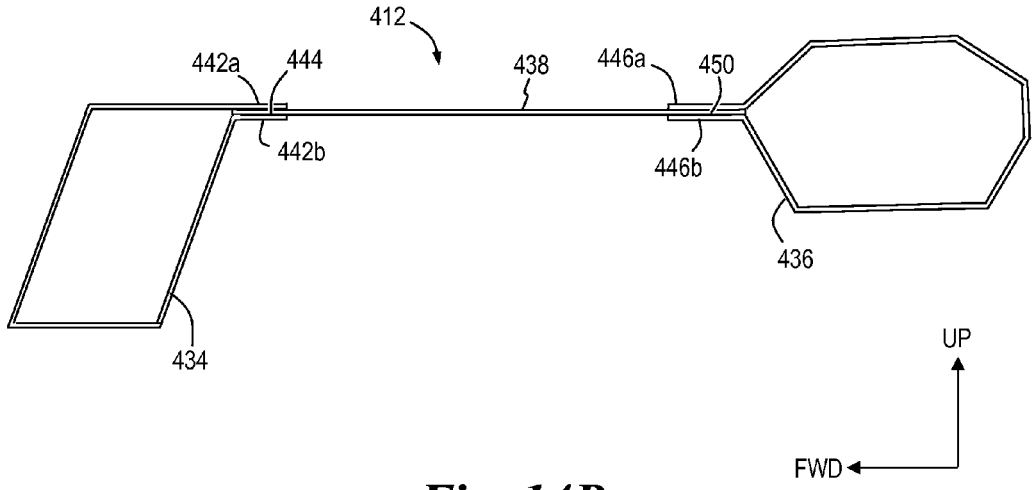
FIG. 14B is a view in section of a parcel shelf component of the system of FIG. 14A.

With reference now to FIGS. 14A and 14B a vehicle speaker mounting system 400 is depicted according to yet another embodiment of the present invention. A parcel shelf 412 comprises a forward stiffener 434, an aft stiffener 436 and a generally planar member 438, each being separately constructed. The components of parcel shelf 414 may be fabricated from the same material or made from differing materials. Example materials include, without limitation, steel, aluminum, plastics or composites, among others, typically in the form of sheet or plate material. The components may be formed by any of bending, folding, stamping, casting and machining, among other methods. Forward stiffener 434 is constructed by bending, folding or otherwise forming a selected material to provide a generally tubular form with a pair of flanges 442*a*, 442*b*. A pair of flanges 446*a*, 446*b* are likewise formed with aft stiffener 436. A first longitudinal edge of planar member 438 is inserted between flanges 442*a*, 442*b* and joined thereto. Likewise, a second, opposing longitudinal edge of planar member 438 is inserted between flanges 446*a*, 446*b* and joined thereto. Flanges 442*a*, 442*b*, 446*a*, 446*b* and planar member 438 may be joined by any conventional process such as, without limitation, welding, soldering, using fasteners or adhesive, among others. A speaker 446 may be similar to speaker 14 (FIG. 2A) for direct mounting to parcel shelf 412, or may be similar to speaker 104 (FIG. 9), in which case a mounting adapter 102 such as shown in FIG. 8 may be employed in the manner described above for vehicle speaker mounting system 100. Vehicle speaker mounting system 400 is otherwise similar in construction and assembly to vehicle speaker mounting system 10 and so will not be reiterated here. Likewise, parcel shelf 212 may be used interchangeably with the parcel shelf in vehicle speaker mounting systems 100, 200, 300 discussed herein.

With reference to FIGS. 1-14B, in yet another alternate embodiment of the present invention forward stiffener 34, 234, 334, 434 and/or aft stiffener 36, 236, 336, 436 are only included along a portion of parcel shelf 12, 212, 312, 412 respectively to reinforce only a portion of the longitudinal length of parcel shelf proximate the associated speaker. Other embodiments may utilize only a forward or aft stiffener where the additional reinforcement provided by a second stiffener is not needed. Further, a combination of any of the elements comprising vehicle speaker mounting systems 10, 100, 200, 300 and 400 may also be employed.

A further alternate embodiment of the present invention includes a forward stiffener 34, 234, 334, 434 and aft stiffener 36, 236, 336, 436 comprised of a plurality of structural components, such as sections of tubing or bar stock that are separately formed and then attached to an assembled planar member 238, 438 rather than utilizing sheet material.

While this invention has been shown and described with respect to a detailed embodiment thereof, it will be understood by those skilled in the art that changes in form and detail thereof may be made without departing from the scope of the claims of the invention.

What is claimed is:

1. A vehicle speaker mounting system, comprising:

a parcel shelf having:

at least two stiffeners extending substantially longitudinally along the length of the parcel shelf, a first stiffener being positioned along a front edge of the parcel shelf and a second stiffener positioned along a rear edge of the parcel shelf, each stiffener being formed in a polygonal shape with a stiffener flange portion, and The parcel shelf further including at least one aperture extending through a generally planar portion of the parcel shelf, wherein the aperture is configured to receive a speaker such that the speaker is rigidly attachable to the parcel shelf, the aperture being further configured such that the speaker, when so attached, is supported by the stiffener flange portions of the first and second stiffeners.

2. The vehicle speaker mounting system of claim 1 wherein the stiffener flange portions are joined to an underside of the parcel shelf.

3. The vehicle speaker mounting system of claim 1 wherein the stiffener flange portions are joined to an upper side of the parcel shelf.

4. The vehicle speaker mounting system of claim 1 wherein the parcel shelf and stiffeners are integral, and wherein the stiffeners are produced by at least one of bending, forming and folding.

5. The vehicle speaker mounting system of claim 1 wherein the stiffeners are separate components, each joined to a generally planar member by at least one of fasteners, welding, soldering and adhesive.

6. The vehicle speaker mounting system of claim 5 wherein the stiffener flange portions each comprise a pair of spaced-apart flange members, a longitudinal edge of the planar member being situated between the flange members and joined thereto.

7. The vehicle speaker mounting system of claim 1 wherein the speaker is secured to the parcel shelf with at least one fastener.

8. The vehicle speaker mounting system of claim 1, further comprising a dampening material interposed between the speaker and the parcel shelf.

9. The vehicle speaker mounting system of claim 1, further comprising a mounting adapter interposed between the speaker and the parcel shelf.

10. A vehicle speaker mounting system, comprising:

a parcel shelf comprising:

a forward stiffener along a front edge of the parcel shelf, the forward stiffener being formed in a polygonal shape and extending substantially longitudinally along the length of the parcel shelf and having a flange portion joined to an underside of the parcel shelf, an aft stiffener along a rear edge of the parcel shelf, the aft stiffener being formed in a polygonal shape and extending substantially longitudinally along the length of the parcel shelf and having a flange portion joined to the underside of the parcel shelf, a generally planar portion extending between the forward stiffener and the aft stiffener, and at least one aperture extending through the generally planar portion, wherein the aperture is configured to receive a speaker such that the speaker is rigidly attachable to the parcel shelf, the aperture being further configured such that the speaker, when so attached, is supported by the stiffener flange portions of the forward and aft stiffeners.

11. The vehicle speaker mounting system of claim 10, further comprising a dampening material interposed between the speaker and the parcel shelf.

12. The vehicle speaker mounting system of claim 10, further comprising a mounting adapter interposed between the speaker and the parcel shelf.

13. A method for mounting a speaker into a vehicle, comprising the step of:

installing into the vehicle a parcel shelf having at least two stiffeners extending substantially longitudinally along the length of the parcel shelf, a first stiffener being positioned along a front edge of the parcel shelf and a second stiffener positioned along a rear edge of the parcel shelf, each stiffener being formed in a polygonal shape with a stiffener flange portion, and at least one aperture extending through a generally planar portion of the parcel shelf, a speaker being mountable into the aperture and securable to the parcel shelf such that the speaker is rigidly attached to the parcel shelf, the aperture being further configured such that the speaker, when so attached, is supported by the stiffener flange portions of the first and second stiffeners, wherein the stiffeners deter vibration generated by movement of at least one of the speaker and the parcel shelf.

14. The method of claim 13, further comprising the step of making the stiffeners integral with the parcel shelf.

15. The method of claim 13, further comprising the steps of making the stiffeners separately from the parcel shelf and joining the stiffeners to the parcel shelf.

16. The method of claim 13, further comprising the step of interposing a dampening material between the speaker and the parcel shelf.

17. The method of claim 13, further comprising the step of interposing a mounting adapter between the speaker and the parcel shelf.

* * * * *